United States Patent [19]

Miller et al.

[11] 4,446,660

[45] May 8, 1984

[54] STUCTURAL MEMBER STORAGE DEVICE

[75] Inventors: LeRoy Miller, Minneapolis; Stanley R. Thorud, Brooklyn Center; Eric M. Rivkin, Minnetonka, all of Minn.

[73] Assignee: Liberty Carton Co., Minneapolis, Minn.

[21] Appl. No.: 229,321

[22] Filed: Jan. 29, 1981

[51] Int. Cl.[3] ..... A47B 5/00

[52] U.S. Cl. ..... 52/36; 52/39; 312/245

[58] Field of Search ..... 52/36, 39, 27, 407, 52/95, 406, 631; 108/47, 48; 312/242, 245

[56] References Cited

U.S. PATENT DOCUMENTS

| | | | |
|---|---|---|---|
| 2,172,048 | 9/1939 | Johnson | 52/407 |
| 2,878,955 | 3/1959 | Hagan | 312/242 X |
| 3,602,566 | 8/1971 | Wiley et al. | 312/242 |
| 4,006,948 | 2/1977 | Kessinger | 312/242 |
| 4,076,350 | 2/1978 | Crist | 312/245 X |
| 4,189,878 | 2/1980 | Fitzgerald | 52/95 |
| 4,292,777 | 10/1981 | Story | 52/407 |

*Primary Examiner*—Carl D. Friedman

*Attorney, Agent, or Firm*—Williamson, Bains, Moore & Hansen

[57] ABSTRACT

Containers are designed for utilization of the otherwise wasted space provided between structural members of buildings such as joists and studs. Flaps may be folded into or out of position to vary the width of the container depending on the exact distance between structural members. A drawer-like container may be used between joists and a cabinet with door may be mounted between studs.

3 Claims, 8 Drawing Figures

STUCTURAL MEMBER STORAGE DEVICE

BACKGROUND OF THE INVENTION

A substantial amount of space in the average home goes to waste or is inefficiently utilized. Such space includes the space between studs in garages, basements and other unfinished rooms. Other wasted space includes the area between joists in a building. While homeowners have placed pegs or small shelves between studs to hold tools and other items, it is believed one reason why no commercialized product has been produced is that while ostensibly the distance between studs is a standard distance, in reality that distance can vary substantially. It is, therefore, an object of the invention to produce a storage device which is capable of being mounted between structural members and which is adaptable to slightly varying distances between those members.

SUMMERY OF THE INVENTION

In using the instant invention as a device for storage between joists, a shelf is provided for supporting a box or the like between joists. This shelf is comprised of a central panel having a plurality of foldable flaps along opposing edges thereof. Depending on the exact distance between joists, none, some or all of these flaps may be employed to vary the effective width of the shelf. A substantial aperture is placed in the center of the shelf in order to allow the homeowner to nail the shelf into position between the joists.

For use between studs, the instant invention utilizes a box which may have shelves inside and which may have a hinged cover if desired. The box is provided with one or more flaps in the back thereof which may be folded into position as noted above for varying the effective width of the container.

These and other objects and advantages of the invention will become readily apparent as the following description is read in conjunction with the accompanying drawings wherein like reference numerals are used to refer to the views.

DESCRIPTION OF THE PREFERRED EMBODIMENT

Figure 1:
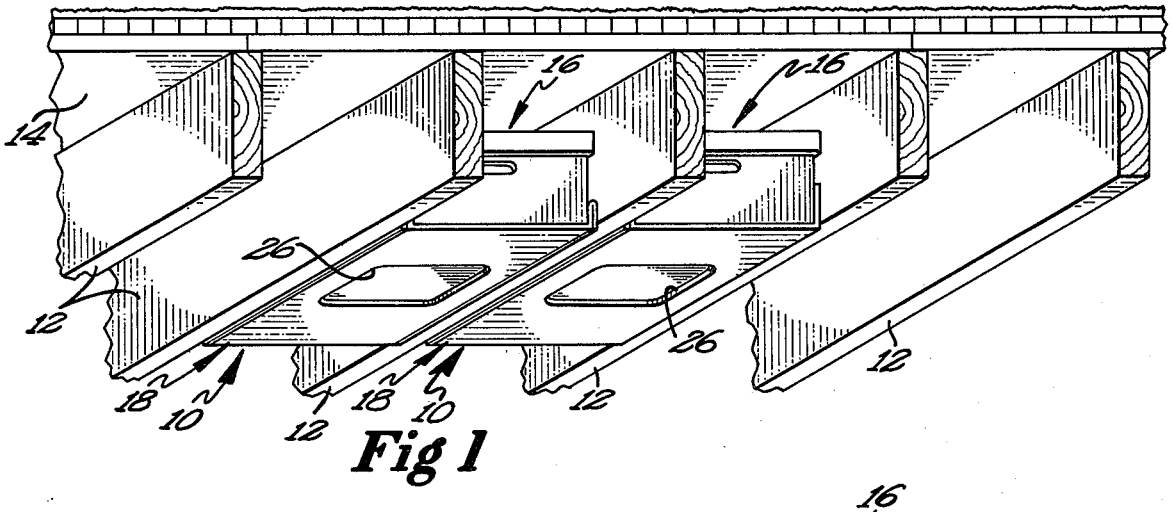
FIG. 1 is a perspective view showing a first embodiment of the invention.
Figure 2:
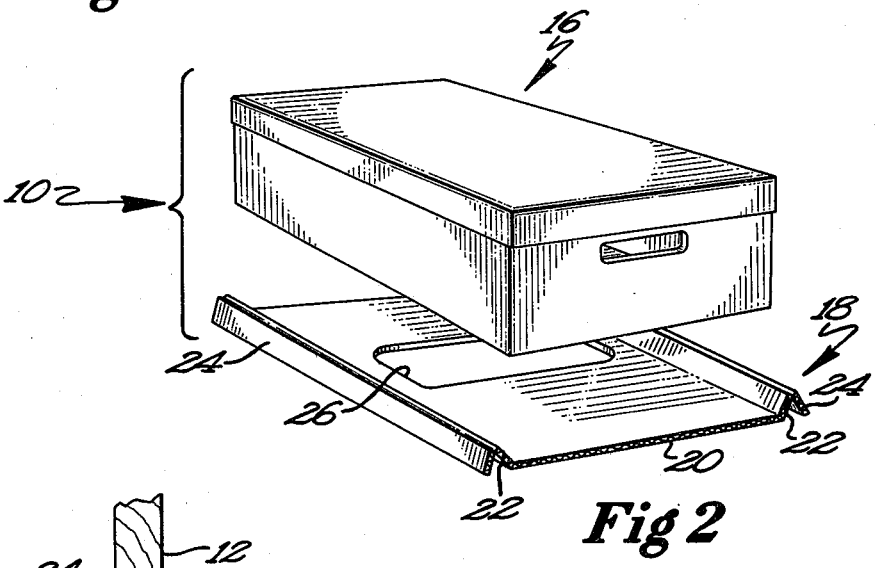
FIG. 2 is a perspective view of the first embodiment.

As shown in FIG. 1, the instant invention, generally 10, is designed for placement between joists 12 which typically are located in a basement and which underlie floor 14. While joists 12 are typically spaced a given distance apart, that distance does vary somewhat from joist to joist. Invention 10 is comprised of a box or other container 16 which may be of any conventional type and which may or may not have a lid and a shelf 18 shown more particularly in FIG. 2. Shelf 18 is comprised of a central panel 20 having inner flaps 22 hinged thereto at opposite sides thereof and outer or secondary flaps 24 hinged to the outer edge of inner flaps 22. Typically, the hinging is by means of score lines or other conventional technique. If desired, further flaps may be added to increase the spacing capability. A central aperture 26 is provided in shelf 18 for allowing access by the installer to insert nails and the like as shown and described hereinafter.

Figure 3:
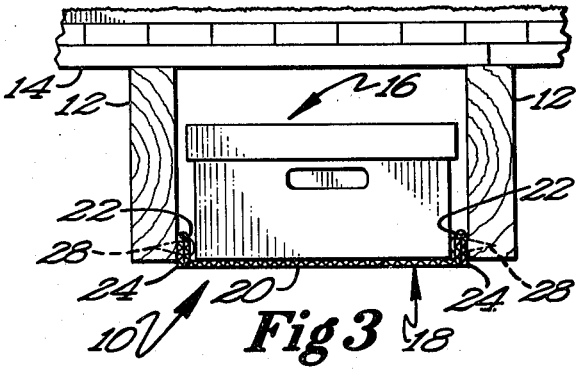
FIG. 3 is an end view showing the invention in place.
Figure 6:
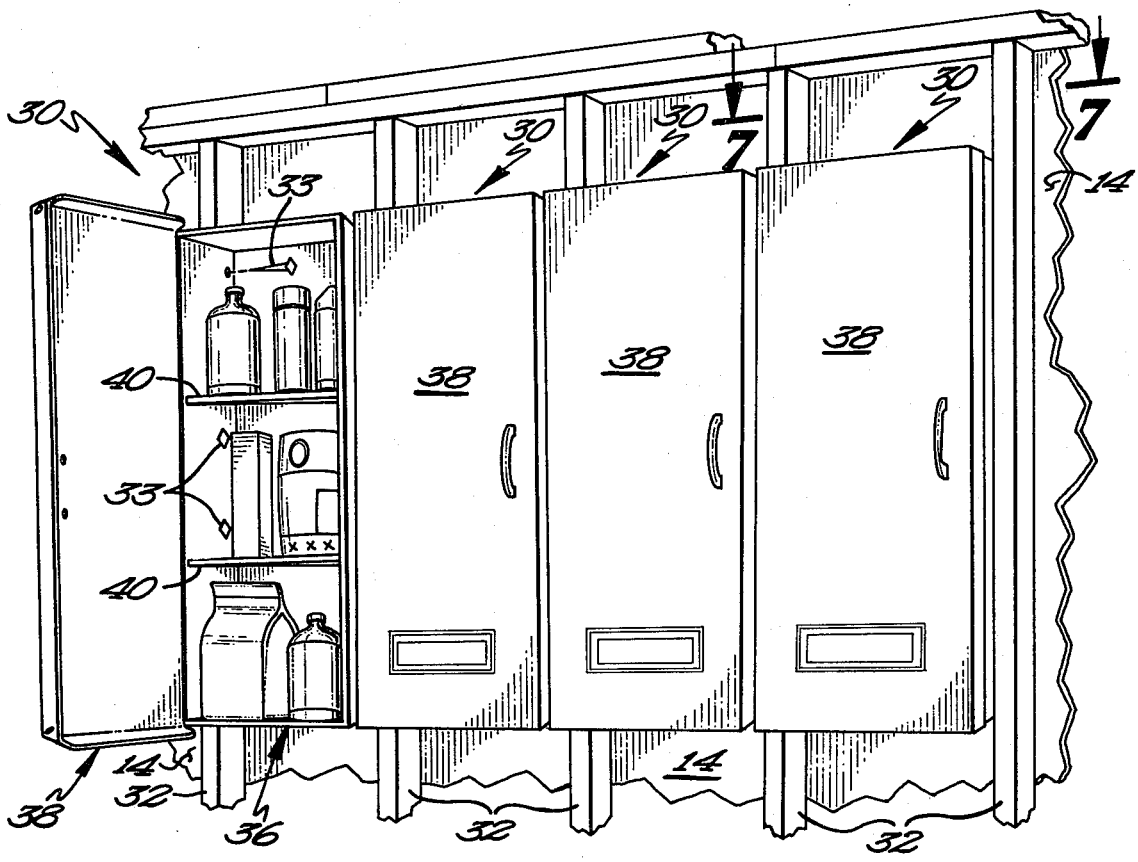
FIG. 6 is a perspective view of the second embodiment.

FIG. 3 shows the invention in place between a pair of joists 12. In the version shown in FIG. 3, joists 12 are fairly widely spaced and thus the spacing ability of both outer flaps 24 is utilized with flaps 24 being folded parallel to and adjacent to inner flaps 22 thereby providing a spacing function. Nails 28 are driven through inner and outer flaps 22 and 24 respectively and into joists 12 in order to secure shelf 18. Access to the full length of inner flap 22 for nailing purposes may be had either from the end of shelf 18 or through aperture 26 in central panel 20 of shelf 18.

While container 16 and shelf 18 are typically formed of corrugated material, of course other suitable materials may be utilized.

Figure 4:
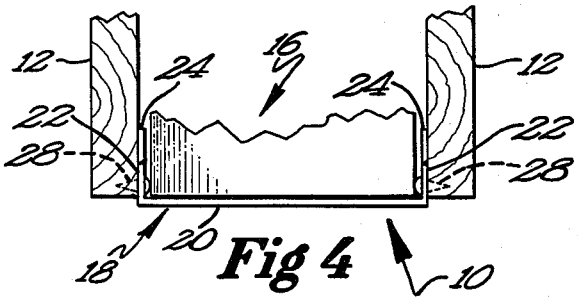
FIG. 4 shows a different application of the device shown in FIG. 3

FIG. 4 shows a pair of relatively narrowly spaced joists 12 and thus outer flaps 24 are left co-planar with inner flaps 22 and merely extend upwardly as shown.

Figure 5:
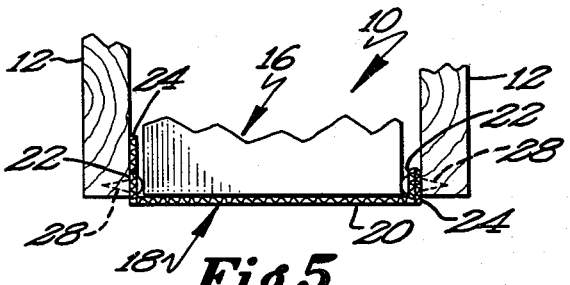
FIG. 5 shows yet another application of the device shown in FIG. 3.

FIG. 5 discloses an intermediate situation wherein one outer flap 24 is left unfolded and the other outer flap 24 is folded downwardly to provide a lesser amount of spacing.

In the second embodiment, the device generally 30, is designed for installation between studs 32 of a wall 34 which is also unfinished. Device 30 is generally a box 36 which may have a hinged lid 38 and/or shelves 40.

Figure 7:
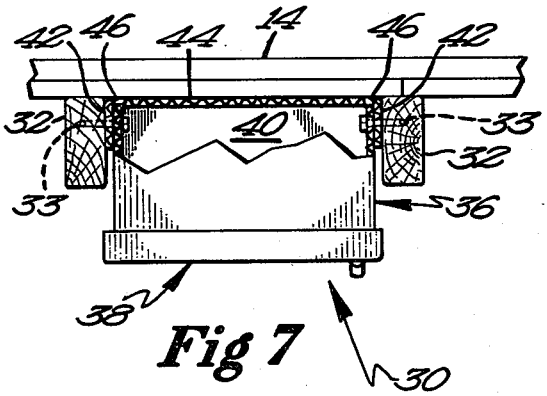
FIG. 7 is a sectional view taken along lines 7—7 of FIG. 6.
Figure 8:
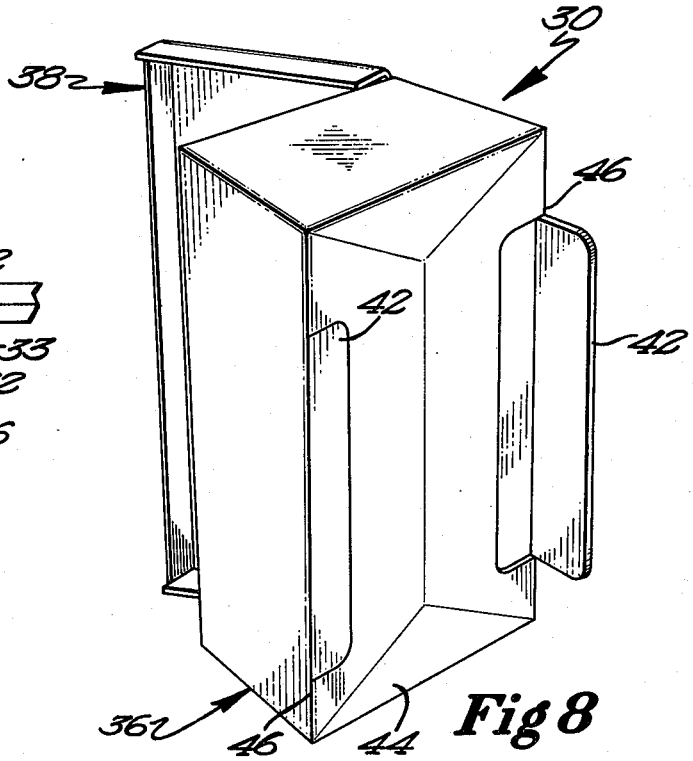
FIG. 8 is a perspective view of the embodiment shown in FIG. 6.

As shown particularly in FIG. 8, spacing flaps 42 are cut and formed out of a portion of the back 44 of box 36 and are hinged along the edge 46 of box 36. Like the first embodiment of the invention, one or both of spacing flaps 42 may be swung into position as shown in FIG. 7 in order to account for the variable spacing between studs 32. Similarly, as shown in FIGS. 3 through 5, one or none of spacing flaps 42 may be folded into position if the spacing in between studs 32 is somewhat less. Device 30 is fastened into position by nails 33 or other suitable fastening devices and is typically manufactured from corrugated material.

While the preferred embodiments of the present invention have been described, it should be understood that various changes, adaptations and modifications may be made therein without departing from the spirit of the invention and the scope of the appended claims.

What is claimed is:

1. A building storage system for location between and attachment to structural members of a building, said system comprising:

a container;

means for attaching said container between adjacent structural members; and means for snugly and adjustably spacing said attachment means between said structural members, wherein said structural members are joists and said container is sized to fit between said joists and said attachment means comprises a central panel substantially the width of said container, said attachment means further comprising a plurality of spacing panels hingedly attached to said central panel, said spacing panels comprising:

at least one first spacing panel hingedly attached to a first side of said central panel;

at least one second spacing panel hingedly attached to a second side of said central panel, said second side being opposite said first side; and at least one secondary spacing panel hingedly attached to one of said first and second spacing panels opposite said central panel, said spacing panels being selectively foldable to vary the effective width of said central panel.

2. The building storage system of claim 3 wherein said central panel has an aperture therein sized to pass a hand therethrough.

3. A building storage system for location between and attachment to studs of a building, said system comprising:

a container comprising a rear wall and first and second side walls;

means for attaching said container between adjacent studs, wherein said attachment means comprises at least one flap formed from a portion of said rear wall of said container, each said flap being swingable between a first position overlying the outer face of a portion of one of said sidewalls of said container and a second position between said side walls and coplanar with said rear wall so as to enable selective variation of the effective width of said container.

* * * * *